US010156008B2

(12) United States Patent
Fujikawa et al.

(10) Patent No.: US 10,156,008 B2
(45) Date of Patent: Dec. 18, 2018

(54) METHOD FOR ALTERING SURFACE OF METAL, AND METALLIC PRODUCT

(71) Applicant: AIR WATER NV INC., Amagasaki-shi, Hyogo (JP)

(72) Inventors: Hisao Fujikawa, Amagasaki (JP); Atsushi Miyamoto, Amagasaki (JP); Morihiro Fujita, Amagasaki (JP)

(73) Assignee: AIR WATER NV INC. (JP)

( * ) Notice: Subject to any disclaimer, the term of this patent is extended or adjusted under 35 U.S.C. 154(b) by 39 days.

(21) Appl. No.: 15/510,343

(22) PCT Filed: Oct. 5, 2015

(86) PCT No.: PCT/JP2015/078129
§ 371 (c)(1),
(2) Date: Mar. 10, 2017

(87) PCT Pub. No.: WO2016/056491
PCT Pub. Date: Apr. 14, 2016

(65) Prior Publication Data

US 2017/0283934 A1 Oct. 5, 2017

(30) Foreign Application Priority Data

Oct. 7, 2014 (JP) ..... 2014-206236

(51) Int. Cl.

| | |
|---|---|
| ***C22F 1/10*** | (2006.01) |
| ***C23C 8/26*** | (2006.01) |
| ***C23C 12/00*** | (2006.01) |
| ***C21D 1/06*** | (2006.01) |
| ***C23C 8/24*** | (2006.01) |
| ***C23C 8/02*** | (2006.01) |
| ***C23C 8/08*** | (2006.01) |
| ***C23C 8/80*** | (2006.01) |
| ***C23C 10/02*** | (2006.01) |
| ***C23C 10/28*** | (2006.01) |
| ***C23C 10/30*** | (2006.01) |
| ***C23C 10/32*** | (2006.01) |
| ***C23C 10/34*** | (2006.01) |
| ***C23C 10/36*** | (2006.01) |
| ***C23C 12/02*** | (2006.01) |
| ***C23C 28/00*** | (2006.01) |
| *C22F 1/00* | (2006.01) |

(52) U.S. Cl.

CPC ..... *C23C 12/00* (2013.01); *C21D 1/06* (2013.01); *C22F 1/10* (2013.01); *C23C 8/02* (2013.01); *C23C 8/08* (2013.01); *C23C 8/24* (2013.01); *C23C 8/26* (2013.01); *C23C 8/80* (2013.01); *C23C 10/02* (2013.01); *C23C 10/28* (2013.01); *C23C 10/30* (2013.01); *C23C 10/32* (2013.01); *C23C 10/34* (2013.01); *C23C 10/36* (2013.01); *C23C 12/02* (2013.01); *C23C 28/00* (2013.01); *C22F 1/00* (2013.01)

(58) Field of Classification Search

CPC .. C23C 8/24; C23C 8/26; C23C 10/28; C23C 10/30; C23C 10/32; C22F 1/06; C22F 1/10

See application file for complete search history.

(56) References Cited

FOREIGN PATENT DOCUMENTS

| | | | | |
|---|---|---|---|---|
| JP | 57-134551 A | | 8/1982 | |
| JP | 63-274753 A | | 11/1988 | |
| JP | 01-177354 A | | 7/1989 | |
| JP | 2008-150706 A | | 7/2008 | |
| JP | 2013-185220 A | | 9/2013 | |
| JP | 2013185220 | * | 9/2013 | ..... C23C 10/50 |

OTHER PUBLICATIONS

English Abstract and English Machine Translation of Hiromatsu et al. (JP 01-177354). (Jul. 13, 1989).*

International Preliminary Report on Patentability and Written Opinion, dated Apr. 11, 2017 in PCT/JP2015/078129.

International Search Report dated Dec. 15, 2015 in International Application No. PCT/JP2015/078129.

* cited by examiner

*Primary Examiner* — Jessee R Roe

(74) *Attorney, Agent, or Firm* — Wood, Phillips, Katz, Clark & Mortimer

(57) ABSTRACT

Provide a metal surface reforming method enabling metallic products with superior characteristics such as surface hardness, heat resistance, corrosion resistance, high temperature oxidation, high temperature corrosion, and environmental corrosion and the like.

Halogenation treatment of heating and retaining a base material in an atmosphere containing a halogen based gas is performed on a base material of iron based metal or nickel based metal, then nitride processing of heating and retaining the halogenated base material described above in an atmosphere containing a nitrogen source gas is performed, then chromizing treatment is performed by placing the nitrided base material in a powder containing metal chromium powder to form a surface reformed layer on the base material described above. These metallic products obtained have high hardness, superior heat resistance and corrosion resistance, and exhibit superior performance in high temperature oxidation, high temperature corrosion, erosion, and cavitation and the like environments. Further, the metallic products described above exhibit superior performance in acid or alkali environments, neutral environments, and corrosive environments such as chlorides like salt water.

8 Claims, 9 Drawing Sheets

METHOD FOR ALTERING SURFACE OF METAL, AND METALLIC PRODUCT

TECHNICAL FIELD

The present invention is related to a metal surface reforming method and to metal products obtained thereby.

RELATED ART

Technology enabling forming a chromium nitride on the surface of iron based metal for enhancing the abrasion resistance, oxidation resistance, and corrosion resistance for the iron based metal is well known. Documentation that disclose this type of technology include, for example, patent references 1 to 4.

REFERENCE DOCUMENT(S) OF CONVENTIONAL ART

Patent Documents

Patent Document 1: US Patent publication 4242151

Patent Document 2: Japan Examined Patent Application S42-24967

Patent Document 3: Japan Examined Patent Application H03-65435

Patent Document 4: Japan Unexamined Patent Application 2000-178711

Patent Document 1 described above describes first nitriding an iron alloy material and then chromizing to form a surface layer made up of carbonitride of chromium.

Patent Document 2 provides the following disclosure.

In general, nitriding or carbonitriding thermal processing is performed on the sprag pieces or other parts being processed according to the present invention in preparation for well known chromizing surface hardening processing. (Public bulletin page 1, right column rows 3 to 6).

"By combining preparatory nitriding in an ammonia containing atmosphere or other arbitrary suitable conventional well known nitride production method and subsequent chromizing processing, all of the advantages of a normal chromium carbine outer skin are obtained and the integration bond strength with the base metal of the body, difficulty to peel, tear, or delaminate, and resistance to corrosion and wear of the surface layer or outer skin obtained on the product are superior to the surface layer or outer skin obtained through electrodeposition or other coating or coating deposition method". (Public bulletin page 1, right column rows 13 to 23)

Patent Document 3 provides the following disclosure.

"The present invention is an iron alloy material surface treatment method of nitride processing for forming a nitride layer of iron-nitrogen or iron-carbon-nitrogen and then forming a surface layer made up of a chromium nitride or carbonitride on the surface of the iron alloy material by causing the iron alloy material and chromium material to coexist with a processing material made up of one or more of an alkali metal or the chloride, fluoborate, fluoride, oxide, bromide, iodide, carbonate, nitrate, or borate, or one or both of halogenated ammonium salt or metal halide of an alkali earth metal, heat treating at a temperature of 680° C. or lower to diffusion penetrate chromium into the surface of the iron alloy material." (Public bulletin page 2, right column rows 9 to 22).

"With the present invention, the iron alloy material is the processed material upon which a chromium nitride or carbonitride layer is formed." (Public bulletin page 2, right column rows 23 to 25).

Patent Document 4 provides the following disclosure.

"The present invention is nitride processing an iron based material, forming a nitride layer made up of at least one of iron nitride and iron carbonitride on the surface thereof, and performing heat treatment at a temperature greater than 500° C. and less than 700° C. of the iron based material in a processing agent with a primary constituent being at least one of an alkali metal chloride and alkali earth metal chloride and containing chromium and glass primarily made up of silicon oxide to diffuse chromium into the nitride layer described above and form at least one compound of chromium nitride and chromium carbonitride." (0014).

"Of the various types of nitride processing described above, in particular, the most preferred is the combined treatment of fluorination and gas nitrocarburizing treatment made up of initially heating and retaining an iron based material in a fluorine-based atmosphere to generate a fluoride film on the surface and then heating in a nitrogen atmosphere to form a nitride layer." (0017).

SUMMARY OF THE INVENTION

Problem(s) to be Solved by the Invention

Patent Document 1 describes performing chromizing treatment after nitride processing is performed on the iron alloy material.

However, the nitride processing disclosed in reference 1 is nothing more than heating at a temperature of 450 to 650° C. in a mixed atmosphere of nitrogen and hydrogen for 40 hours.

In other words, if the nitride layer is not obtained with this nitride processing method, the target surface layer made up of chromium carbonitride is not obtained even if chromizing treatment is performed.

Patent Document 2 is performing nitriding or carbonitriding on an iron allow part as preparation and then performing chromizing surface hardening treatment.

However, the nitride processing disclosed in reference 2 is nothing more than a method for preliminary nitriding in an atmosphere containing ammonia.

In other words, if the nitride layer is not obtained with this nitride processing method, the target surface layer made up of chromium carbonitride is not obtained even if chromizing treatment is performed.

Patent Document 3 described above is forming a nitride layer on the surface of an iron based material using so called salt bath processing and then forming a surface layer made up of a nitride or carbonitride of chromium on the surface of the iron based material by diffusing chromium into the surface of the iron alloy material.

However, in reference 3, a cyanide based chemical is included in the processing agent for the salt bath for performing nitride processing and so has a problem of being a major burden on the environment.

Patent Document 4 described above is performing fluorination treatment and nitride processing on an iron based material to form a nitride layer and diffusion penetrating chromium on the iron based material in a salt bath.

However, reference 4 has the problem that the amount of chromium that will dissolve in the salt bath is very small preventing forming of a thick chromium carbonitride layer.

The present invention is to resolve the problems described above and with the objective described below provides a metal surface reforming method and metallic product obtained thereby.

(1) Forming a thick and uniform chromium nitride surface layer with extremely high hardness and excellent heat resistance and corrosion resistance. For example, for automotive parts, applicability to parts requiring heat resistance and wear resistance such as a turbocharger and turbine blades.

(2) For example, for molds that use a diecast of aluminum, magnesium, or zinc or the like, this prevents dissolution loss into the alloy and maintains superior performance.

(3) This exhibits superior performance in high temperature oxidation, high temperature corrosion, erosion, cavitation, cavitation/erosion and the like environments and is applicable for a lot of parts such as blade materials, valve materials, and pump materials in the chemical industry, thermal power generation, and alternative energy and the like environments.

(4) Exhibits superior performance in acid or alkali environments, neutral environments, and corrosive environments such as chlorides like salt water and is applicable to materials and parts used in these environments.

Means for Solving the Problem

The metal surface reforming method of claim 1 adopted the following configuration to achieve the objective described above.

Performing nitride processing on a base material of iron based metal or nickel based metal of heating and retaining the base material in an atmosphere containing a nitrogen source gas, and then performing chromizing treatment by heating and retaining the nitrided base material in a powder containing metallic chromium at a temperature of 850 to 1200° C. to form a surface reformed layer on the base material described above.

The metal surface reforming method of claim 2 adopted the following configuration in addition to the configuration disclosed in claim 1.

The surface reformed layer described above includes two layers, the chromium nitride layer formed on the surface and the chromium enriched layer formed underneath the layer.

The metal surface reforming method of claim 3 adopted the following configuration in addition to the configuration disclosed in claim 1 or 2.

The nitride processing described above forms a nitride layer containing a nitrogen diffusion layer with a nitrogen concentration of 10 atom % or higher and thickness of 5 μm or more.

The metal surface reforming method of claim 4 adopted the following configuration in addition to the configuration disclosed in anyone of claims 1 to 3.

The base material described above is an austenite based metal.

The metal surface reforming method of claim 5 adopted the following configuration in addition to the configuration disclosed in anyone of claims 1 to 4.

Halogenation treatment of heating and retaining the base material described above in an atmosphere containing a halogen based gas is performed prior to nitride processing.

The metallic product of claim 6 adopted the following configuration to achieve the objective described above.

A surface reformed layer including two layers, a chromium nitride layer formed on the surface and a chromium enriched layer formed underneath this layer is formed on a base material of an iron based metal or nickel based metal.

The metallic product of claim 7 adopted the following configuration in addition to the configuration disclosed in claim 6.

The base material described above is an austenite based metal.

Effects of the Invention

An iron based metal or nickel based metal base material is prepared for the metal surface reforming method according to claim 1. The surface of iron based metals and nickel based metals are covered with an oxide film or passive film. When there is an oxide film or passive film on the surface, this generally hinders diffusion penetration of nitrogen atoms. Nitride processing of heating and retaining the base material described above in an atmosphere containing a nitrogen source gas is performed. This nitride processing causes diffusion penetration of nitrogen atoms onto the surface of the base material activated through halogenation treatment. Thereafter, chromizing treatment of heating and retaining the base material nitrided above at a temperature of 850 to 1200° C. in a powder containing metal chromium powder is performed. This chromizing treatment forms a surface reformed layer by diffusion penetrating chromium atoms into the surface layer diffusion penetrated with nitrogen atoms.

The metal surface reforming method according to claim 2 is that the surface reformed layer described above includes two layers, a chromium compound layer formed on the surface and the chromium enriched layer formed underneath the layer.

The chromizing treatment described above diffusion penetrates chromium atoms into the surface layer diffusion penetrated with nitrogen atoms. Thus a chromium compound layer is formed on the surface and a chromium enriched layer is formed underneath this layer. The chromium compound layer on the surface is hard and has superior wear resistance. Further, the chromium compound layer described above is chemically stable and with the chromium enriched layer formed underneath, exhibits high resistance to solution corrosion at low temperatures and high resistance to oxidation at high temperatures.

The nitride processing described above forms a diffusion layer of diffused nitrogen with a nitrogen concentration of 10 atom % or higher and thickness of 5 μm or more.

Diffusion penetration of chromium atoms through chromizing treatment of a base material onto which a diffusion layer has been formed enables forming a surface reformed layer including two layers, a chromium compound layer formed on the surface and a chromium enriched layer formed underneath this layer as has been described above.

The meaning of forming a surface reformed layer including two layers, a chromium compound layer and chromium enriched layer as described above is that in the nitride processing described above, forming of a nitride layer where a nitrogen diffusion layer as described above is formed without forming a nitrogen compound layer on the outermost surface is preferable.

With the metal surface reforming method of claim 4, the base material described above is austenite based metal.

The surface of austenite based metals is normally covered with a passive film. If heated and retained in a nitriding atmosphere as-is, nitrogen atoms would not at all readily diffuse and penetrate. Therefore, even if the nitride processing and chromizing treatment is performed on austenite based metals, the surface reformed layer of the present invention would not be obtained. Here, the surface of the base material that is an austenite based metal is activated by removing the passive film through halogenation treatment described above and thereafter, diffusion and penetration of nitrogen through nitride processing enables forming the surface reformed layer including two layers of a chromium compound layer and chromium enriched layer described above using chromizing treatment.

Further, forming a surface reformed layer including two layers of a chromium compound layer and chromium enriched layer on the base material that is an austenite based metal enables obtaining metal products with superior properties. These metal products have high hardness, superior heat resistance and corrosion resistance, and exhibit superior performance in high temperature oxidation, high temperature corrosion, erosion, and cavitation and the like environments. Further, the metal products described above exhibit superior performance in acid or alkali environments, neutral environments, and corrosive environments such as chlorides like salt water. Further, for automotive parts, the metal products described above are applicable to parts requiring heat resistance and wear resistance such as a turbocharger. Further, for example, for molds that use a diecast of aluminum, magnesium, or zinc or the like, this prevents dissolution loss into the alloy and maintains superior performance. Further, this is applicable for a lot of parts such as blade materials, valve materials, and pump materials in the chemical industry, thermal power generation, and alternative energy and the like environments. Further, this can be applied to materials and parts used in acid or alkali environments, neutral environments, or corrosive environments such as chlorides like salt water.

The metal surface reforming method of claim 5 is halogenation treatment of heating and retaining the base material described above in an atmosphere containing a halogen based gas prior to nitride processing. This halogenation treatment removes the oxide film or passive film on the surface of the base material and forms a thin film of metal halide. Removal of the oxide film or passive film on the surface activates the surface and simplifies diffusion and penetration of nitrogen atoms in subsequent nitride processing.

The metallic product disclosed in claim 6 is the forming of a surface reformed layer including two layers, a chromium compound layer formed on the surface and chromium enriched layer formed underneath this layer on a base material of iron based metal or nickel based metal.

The chromium compound layer on the surface is hard and has superior wear resistance. Further, the chromium compound layer described above is chemically stable and with the chromium enriched layer formed underneath, exhibits high resistance to solution corrosion at low temperatures and high resistance to oxidation at high temperatures.

With the metallic product of claim 7, the base material described above is austenite based metal.

Forming a surface reformed layer including two layers of a chromium compound layer and chromium enriched layer on the base material that is an austenite based metal enables obtaining metal products with superior properties. These metal products have high hardness, superior heat resistance and corrosion resistance, and exhibit superior performance in high temperature oxidation, high temperature corrosion, erosion, and cavitation and the like environments. Further, the metal products described above exhibit superior performance in acid or alkali environments, neutral environments, and corrosive environments such as chlorides like salt water. Further, for automotive parts, the metallic products described above are applicable to parts requiring heat resistance and wear resistance such as a turbocharger. Further, for example, for molds that use a diecast of aluminum, magnesium, or zinc or the like, this prevents dissolution loss into the alloy and maintains superior performance. Further, this is applicable for a lot of parts such as blade materials, valve materials, and pump materials in the chemical industry, thermal power generation, and alternative energy and the like environments. Further, this can be applied to materials and parts used in acid or alkali environments, neutral environments, or corrosive environments such as chlorides like salt water.

BRIEF DESCRIPTION OF THE DRAWINGS

FIG. 5 (*b*) is the element distribution condition of the surface reformed layer formed on the example.

MODES FOR CARRYING OUT THE INVENTION

Figure 1:
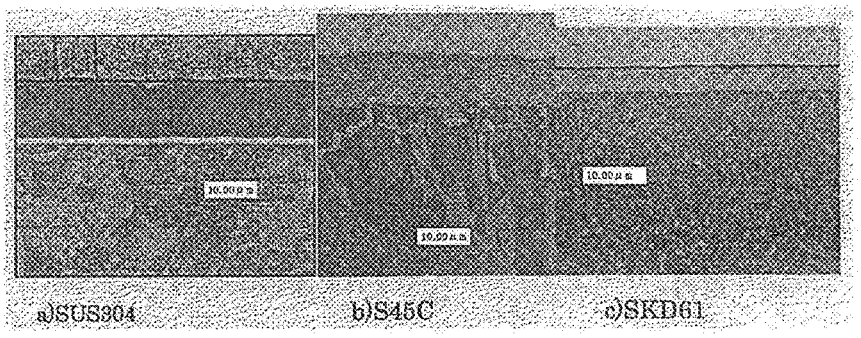
FIG. 1 is a cross-sectional micrograph of a comparative example.

Next, modes for carrying out the invention will be described.

Development Chronology

Forming a nitride layer on a surface layer via nitride processing and then forming a layer with a high amount of Cr through chromizing treatment is well known. This type of nitride processing and chromizing treatment are respectively being performed independently on a regular basis.

The present invention is the effective combination of nitride processing and chromizing treatment and successful formation of a thick uniform chromium compound layer on the surface of a metallic product.

In general, the PVD method and CVD method are technologies for forming a chromium nitride layer on the surface of a metallic product. The thickness of the chromium nitride layer formed using the PVD method or CVD method described above is at best, 10 μm or less.

There is a limit to the thickness of a chromium nitride layer formed using the PVD method described above. It is not possible to form the thick layer obtained with the present invention. Further, the chromium nitride formed is not sufficiently diffused in the base material. In other words, the chromium nitride layer is adhered only by mechanical attraction and slight diffusion. Therefore, the chromium nitride layer peels easily under mechanical forces or temperature changes. Further, preventing forming of pinholes in the surface layer is difficult making it so sufficient corrosion resistance is not obtained.

With the CVD method described above, diffusion occurs between the chromium nitride and the base material so adhesion is improved. However, regarding the point of there being a limit to the thickness of a chromium nitride layer formed, this is the same as the PVD method Further, regarding the point of difficulty in preventing pinholes and inability to obtain sufficient corrosion resistance, this is also the same as the PVD method.

In order to prevent pinholes using the PVD method and CVD methods, a plurality of material layers have to be coated on the surface of the base material so that pin holes do not reach the base material. This requires very complex processing making processing costs very high.

On the other hand, other than the PVD method and CVD method, chromium nitride layers are formed using low temperature TD processing. With this method, a nitrided non-treated material is immersed in a salt bath with alkali chloride as the main constituent. Heating and retaining at a temperature of roughly 570° C. enables forming a very thin film of roughly 5 μ with a high amount of chromium nitride on the surface.

However, as the process temperature for this method is low so the chromium atoms do not diffusion penetrate very deeply. Therefore, with this method, in this process course, first iron nitrides are formed on the surface and then a part of the iron atoms that make up the iron nitride are replaced with chromium atoms generating chromium nitride. With this type of chromium nitride generating mechanism, fully preventing defects such as pin holes is difficult. Therefore, sufficient corrosion resistance cannot be obtained. Further, surface hardness stops at roughly Hv 1000.

The present invention is the effective combination of nitride processing and chromizing treatment and forming of a surface reformed layer including a thick uniform chromium compound layer on the surface of a metallic product.

The present invention differs from the conventional methods described above in that there are few restrictions on the thickness of the chromium nitride layer to be obtained, pin holes are few, and a thick chromium nitride layer can easily be obtained. In other words, the chromium nitride layer can be formed to a thickness needed for the application. Further, a chromium enriched layer with a higher concentration of chromium than the base material is generated with sufficient thickness is formed underneath this layer. Therefore, superior corrosion resistance can be obtained with regards to both high temperature corrosion and low temperature solution corrosion. In addition, a surface with a hardness of roughly Hv 1600 can be formed providing superior wear resistance.

In addition to the nitride processing described above, nitrocarburizing treatment that is simultaneous diffusion penetration of nitrogen atoms and carbon atoms can be applied in addition to nitride processing of diffusion penetration of only nitrogen atoms. In this case, the surface reformed layer obtained through chromizing treatment performed thereafter is a chromium carbonitride layer. It was found that roughly the same corrosion resistance and surface hardness could be obtained.

In other words, the chromium compound layer formed in the surface reformed layer obtained using the present invention includes both a chromium nitride layer and a chromium carbonitride layer. In nitride processing, if only nitrogen atoms are diffusion penetrated and this is combined with chromizing treatment, a chromium nitride layer is formed in the surface reformed layer. In nitride processing, if both nitrogen atoms and carbon atoms are diffusion penetrated and this is combined with chromizing treatment, a chromium carbonitride layer is formed in the surface reformed layer.

With regards to combining nitride processing and chromizing treatment, for example, performing of nitride processing after chromizing treatment, the opposite of the present invention can be considered. However, a layer with a very high amount of Cr (chrome concentration of 70 mass % or more in outermost layer) is formed in the surface layer during chromizing treatment. Therefore, nitrogen does not diffusion penetrate into the base material during the subsequent nitride processing. In other words, the uniform thick chromium nitride layer or chromium carbonitride layer obtained with the present invention is not formed with this method.

Similar to the Egg of Columbus, through combining a plurality of technologies, the present invention is related to completely new knowledge obtained.

Example 1

The following processes are performed on the metal surface reforming method of the present example.

Halogenation treatment of heating and retaining a base material in an atmosphere containing a halogen based gas is performed on a base material of iron based metal or nickel based metal, then nitride processing of heating and retaining the halogenated base material described above in an atmosphere containing a nitrogen source gas is performed, then chromizing treatment is performed by placing the nitrided base material in a powder containing metal chromium powder to form a surface reformed layer on the base material described above.

Base Material

Iron based metal or nickel based metal is used as the base material described above in the metal surface reforming method of the present example.

Various types of steel materials or iron based alloys can be used as the iron based metal. Various steel types can be used as the steel material or iron based alloy such as carbon steel, alloy steel, nickel chromium steel, nickel chromium molybdenum steel, chromium steel, chromium molybdenum steel, manganese steel, tool steel, stainless steel, heat resistant steel, nitriding steel, or case hardening steel or the like.

Nickel based alloys can be used as the nickel based metal described above. Alloys with a nickel content of 50 weight % or higher can be used as the nickel based alloy described above. Basically nickel-copper systems (Monel), nickel-chromium systems (Inconel), and nickel-molybdenum systems (Hastelloy) and the like can be used.

In particular the base material described above is preferably an austenite based metal. For example austenite based stainless steel can be favorably used.

Halogenation Treatment

The metal surface reforming method of the present example is halogenation treatment of heating and retaining the base material described above in an atmosphere containing a halogen based gas.

The halogenation treatment described above uses a heating furnace where the atmosphere can be controlled and is performed by heating and retaining the base material described above in an atmosphere containing a halogen.

A halogen gas such as $F_2$, $Cl_2$, HCl, $NF_3$ or the like or a halide gas can be used as the halogen used in the atmosphere gas described above.

A mixed gas of 0.5 to 20 volume % halogen and the remaining nitrogen gas, hydrogen gas, or an inert gas can be used as the atmosphere gas described above.

The halogenation treatment described above activates the surface by heating and retaining the base material in the atmosphere gas described above at 200 to 550° C. for roughly 10 minutes to 3 hours.

Nitriding Treatment

In the metal surface reforming method of the present example, nitride processing is performed by heating and retaining the halogenated base material described above in an atmosphere containing a nitrogen source gas.

Anyone of gas nitride treatment, gas nitrocarburizing treatment, salt bath nitrocarburizing treatment, vacuum nitride treatment, ion nitride (plasma nitride) treatment methods can be applied as the nitride processing described above.

The gas nitriding or gas nitrocarburizing can be performed in a nitriding or nitrocarburizing atmosphere in other words heating and retaining the base material after completing halogenation treatment described above in an atmosphere with $NH_3$ as a nitrogen source, $N_2$, CO, $CO_2$, $H_2$ and the like mixed in as necessary.

The salt bath nitriding described above can be performed by heating and retaining the base material after completing halogenation treatment described above in a salt bath with cyanide to cyanic acid as a primary constituent.

Ion nitriding (plasma nitriding) is generating a glow discharge in a 0.1 to 10 Pa nitrogen mixed gas atmosphere with the furnace body as the positive electrode and object being processed the negative electrode through applying a DC voltage of several hundred volts accelerating ionized gas components to high speed and causing them to collide with the surface of the object being processed thus heating and advancing nitriding through the sputtering effect and the like.

The heating temperature and retention time can be suitably specified based on the nitride processing method adopted and the target properties of the surface reformed layer. For example a specified temperature in the range of 350 to 900° C. (preferably 350 to 650° C.) for a specified time can be used for heating and retention.

A nitrogen diffusion layer with a high nitrogen concentration is formed on the outer layer of the base material through the nitride processing described above. During the chromizing treatment subsequently performed, chromium atoms that diffusion penetrate based on the chromizing treatment bond with the nitrogen atoms present in the nitrogen diffusion layer and generate a chromium nitride layer as a chromium compound layer.

In the case that nitrocarburizing treatment is performed as the nitride processing, a carbon-nitrogen diffusion layer with high nitrogen concentration and carbon concentration is formed in the outer layer of the base material. During the chromizing treatment subsequently performed, chromium atoms that diffusion penetrate based on the chromizing treatment bond with the nitrogen atoms and carbon atoms present in the carbon-nitrogen diffusion layer and generate a chromium carbonitride layer as a chromium compound layer.

With the metal surface reforming method of the present example, the nitride processing described above forms a diffusion layer of diffused nitrogen with a nitrogen concentration of preferably 10 atom % or higher and thickness of 5 μm or more.

Normalize treatment can be performed on the surface as necessary after the nitride processing described above and prior to the chromizing treatment. Shot peening or barrel and the like processing can be adopted as the normalize processing.

Chromizing Treatment

With the metal surface reforming method of the present example, chromizing treatment is performed by heating and retaining the nitrided base material described above placed in a powder containing metal chromium powder.

The chromizing treatment described above causes chromium atoms to diffusion penetrate into the surface of the base material after nitride processing is complete.

The chromizing treatment described above can be performed using the powder pack method. The powder pack method is performed by burying the base material after completing nitride processing in process agent powder filled in a heat resistant case, placing the heat resistant case in an atmospheric furnace and heating and retaining while delivering a reaction promoting gas. This causes chromium atoms to diffusion penetrate into the surface of the base material after nitride processing is complete.

A powder agent of metal chromium powder or iron-chromium alloy powder and $Al_2O_3$ to prevent sintering with a small amount of $NH_4Cl$ or $NH_4F$ as a reaction promoter can be used as the process agent powder described above.

$H_2$ or Ar can be used as the reaction promoting gas described above.

Heating and retention is heating at a specified temperature in the range of 850 to 1200° C. (preferably 900 to 1200° C.) and retaining for a specified time. This causes chromium atoms to diffusion penetrate into the surface of the base material after nitride processing is complete forming a surface reformed layer.

Surface Reformed Layer

With the metal surface reforming method of the present example, the halogenation treatment, nitride processing, and chromizing treatment described above form a surface reformed layer on the base material described above.

With regards to the surface reformed layer described above, the surface reformed layer is a layer with chromium nitride as the primary constituent and a layer with a large amount of chromium is formed underneath, this layer. The surface reformed layer with chromium nitride described above as the primary constituent can be formed with a thickness of roughly 1 μm to 100 μm. The layer with a large amount of chromium formed underneath this layer can be formed with a thickness of roughly 100 μm or less.

The surface reformed layer described above preferably includes two layers, a chromium compound layer formed on the surface and a chromium enriched layer formed underneath this layer.

Effect of the Example

The metal surface reforming method of the example described above exhibits the following effects.

An iron based metal or nickel based metal base material is prepared for the metal surface reforming method of the present example. The surface of iron based metals and nickel based metals are covered with an oxide film or passive film. When there is an oxide film or passive film on the surface, this generally hinders diffusion penetration of nitrogen atoms. Halogenation treatment of heating and retaining the base material described above in an atmosphere containing a halogen based gas. This halogenation treatment removes the oxide film or passive film on the surface of the base material and forms a thin film of metal halide. Removal of the oxide film or passive film on the surface activates the surface and simplifies diffusion and penetration of nitrogen atoms in subsequent nitride processing. Next, nitride processing of heating and retaining the halogenated base material described above in an atmosphere containing a nitrogen source gas is performed. This nitride processing causes diffusion penetration of nitrogen atoms onto the surface of the base material activated through halogenation treatment. Thereafter, chromizing treatment of heating and retaining the base material nitrided above in a powder containing metal chromium powder is performed. This chromizing treatment forms a surface reformed layer by diffusion penetrating chromium atoms into the surface layer diffusion penetrated with nitrogen atoms.

Further, the metal surface reforming method according of the present example is that the surface reformed layer described above includes two layers, a chromium compound layer formed on the surface and the chromium enriched layer formed underneath this layer.

The chromizing treatment described above diffusion penetrates chromium atoms into the surface layer diffusion penetrated with nitrogen atoms. Thus a chromium compound layer is formed on the surface and a chromium enriched layer is formed underneath this layer. The chromium compound layer on the surface is hard and has superior wear resistance. Further, the chromium compound layer described above is chemically stable and with the chromium enriched layer formed underneath, exhibits high resistance to solution corrosion at low temperatures and high resistance to oxidation at high temperatures.

Further with the metal surface reforming method of the present example, the nitride processing described above forms a nitride layer containing a nitrogen diffusion layer with a nitrogen concentration of 10 atom % or higher and thickness of 5 μm or more.

Diffusion penetration of chromium atoms through chromizing treatment of a base material onto which a nitride layer has been formed enables forming a surface reformed layer including two layers, a chromium compound layer formed on the surface and a chromium enriched layer formed underneath this layer as has been described above.

The meaning of forming a surface reformed layer including two layers, a chromium compound layer and chromium enriched layer as described above is that in the nitride processing described above, forming of a nitride layer where a nitrogen diffusion layer as described above is formed without forming a nitrogen compound layer on the outermost surface is preferable.

Further, with the metal surface reforming method of the present example, the base material described above is austenite based metal.

The surface of austenite based metals is normally covered with a passive film. If heated and retained in a nitriding atmosphere as-is, nitrogen atoms would not at all readily diffuse and penetrate. Therefore, even if the nitride processing and chromizing treatment is performed on austenite based metals, the surface reformed layer of the present invention would not be obtained. Here, the surface of the base material that is an austenite based metal is activated by removing the passive film through halogenation treatment described above and thereafter, diffusion and penetration of nitrogen through nitride processing enables forming the surface reformed layer including two layers of a chromium compound layer and chromium enriched layer described above using chromizing treatment.

Further, forming a surface reformed layer including two layers of a chromium compound layer and chromium enriched layer on the base material that is an austenite based metal enables obtaining metallic products with superior properties. These metallic products have high hardness, superior heat resistance and corrosion resistance, and exhibit superior performance in high temperature oxidation, high temperature corrosion, erosion, and cavitation and the like environments. Further, the metallic products described above exhibit superior performance in acid or alkali environments, neutral environments, and corrosive environments such as chlorides like salt water. Further, for automotive parts, the metallic products described above are applicable to parts requiring heat resistance and wear resistance such as a turbocharger. Further, for example, for molds that use a diecast of aluminum, magnesium, or zinc or the like, this prevents dissolution loss into the alloy and maintains superior performance. Further, this is applicable for a lot of parts such as blade materials, valve materials, and pump materials in the chemical industry, thermal power generation, and alternative energy and the like environments. Further, this can be applied to materials and parts used in acid or alkali environments, neutral environments, or corrosive environments such as chlorides like salt water.

Metallic Product

The metallic product obtained using the metal surface reforming method described above has the following structure.

A surface reformed layer including two layers, a chromium compound layer formed on the surface and a chromium enriched layer formed underneath this layer is formed on a base material of an iron based metal or nickel based metal.

In particular the base material described above is preferably an austenite based metal.

The metallic product of the example described above exhibits the following effects.

In other words, with the metallic product of the present example, the chromium compound layer on the surface is hard and has superior wear resistance. Further, the chromium compound layer described above is chemically stable and with the chromium enriched layer formed underneath, exhibits high resistance to solution corrosion at low temperatures and high resistance to oxidation at high temperatures.

Further, with the metallic product of the present example, forming a surface reformed layer including two layers of a chromium compound layer and chromium enriched layer on the base material that is an austenite based metal enables obtaining metallic products with superior properties. These metallic products have high hardness, superior heat resistance and corrosion resistance, and exhibit superior performance in high temperature oxidation, high temperature corrosion, erosion, and cavitation and the like environments. Further, the metallic products described above exhibit superior performance in acid or alkali environments, neutral environments, and corrosive environments such as chlorides like salt water. Further, for automotive parts, the metallic products described above are applicable to parts requiring heat resistance and wear resistance such as a turbocharger. Further, for example, for molds that use a diecast of aluminum, magnesium, or zinc or the like, this prevents dissolution loss into the alloy and maintains superior performance. Further, this is applicable for a lot of parts such as blade materials, valve materials, and pump materials in the chemical industry, thermal power generation, and alternative energy and the like environments. Further, this can be applied to materials and parts used in acid or alkali environments, neutral environments, or corrosive environments such as chlorides like salt water.

EXAMPLES

Fluorination treatment, then nitride processing or nitrocarburizing treatment, and finally chromizing treatment using the powder pack method were performed on carbon steel, tool steel, stainless steel, and a Ni based alloy.

Specifically the following steel types were used in the examples and comparative examples described below.

Carbon steel: S45C

Tool steel: SKD61

Stainless steel: SUS304, SUS316, SUS301

Ni based alloy: Alloy718

The process conditions for respective fluorination treatment nitride processing, and chromizing treatment for the examples and comparative examples described below are as follows.

Fluorination Treatment

Atmosphere: fluorine-based gas ($NF_3$ 10 vol %+$N_2$ 90 vol %)

Temperature: 300° C.

Time: 15 minutes

Nitriding Treatment

Gas nitride treatment was performed.

Atmosphere: $NH_3$ 50 vol %+$N_2$ 50 vol %

Temperature: 570° C.

Time: 30 minutes

Nitrocarburizing Treatment

Gas nitrocarburizing treatment was performed.

Atmosphere: $NH_3$ 25 vol %+$N_2$ 60 vol %+CO 10 vol %+$CO_2$ 5 vol %

Temperature: 570° C.

Time: 2 hours

Chromizing Treatment

The material to be processed is buried in process agent powder and heating and retention performed while air flow is delivered.

Process agent: powdered Cr or Fe—Cr alloy with the amount of $Al_2O_3$ needed to prevent sintering added and a small amount of $NH_4Cl$ added as a reaction promoter.

Air flow: hydrogen or argon stream

Temperature: 1050° C.

Time: unless otherwise indicated, 10 hours

FIG. 1 is a cross-sectional micrograph that shows a comparative example. The cross section of a test piece on which fluorination treatment and nitride processing were performed where chromizing treatment was not performed was observed. Base materials were a) SUS304, b) S45C, c) SKD61.

Figure 2:
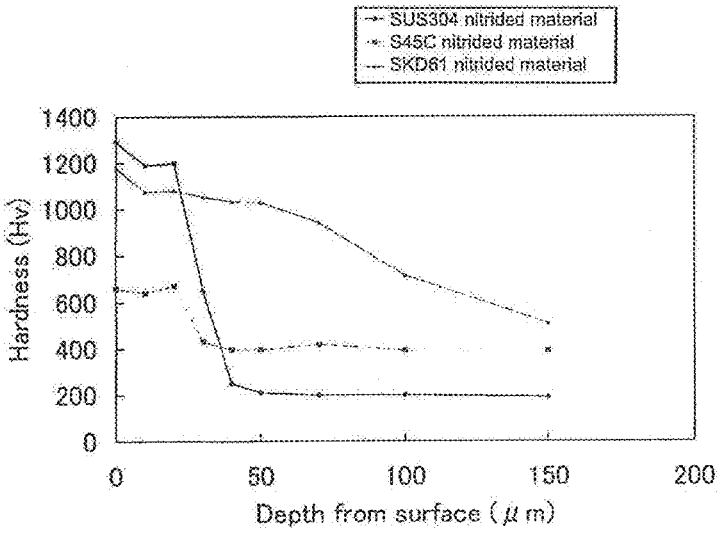
FIG. 2 is the measurement results of the cross-sectional hardness distribution of a comparative example.

FIG. 2 is the measurement results of the cross-sectional hardness distribution showing a comparative example. The cross section hardness of a test piece on which fluorination treatment and nitride processing were performed where chromizing treatment was not performed was measured. Base materials were SUS304, S45C, SKD61.

Figure 3:
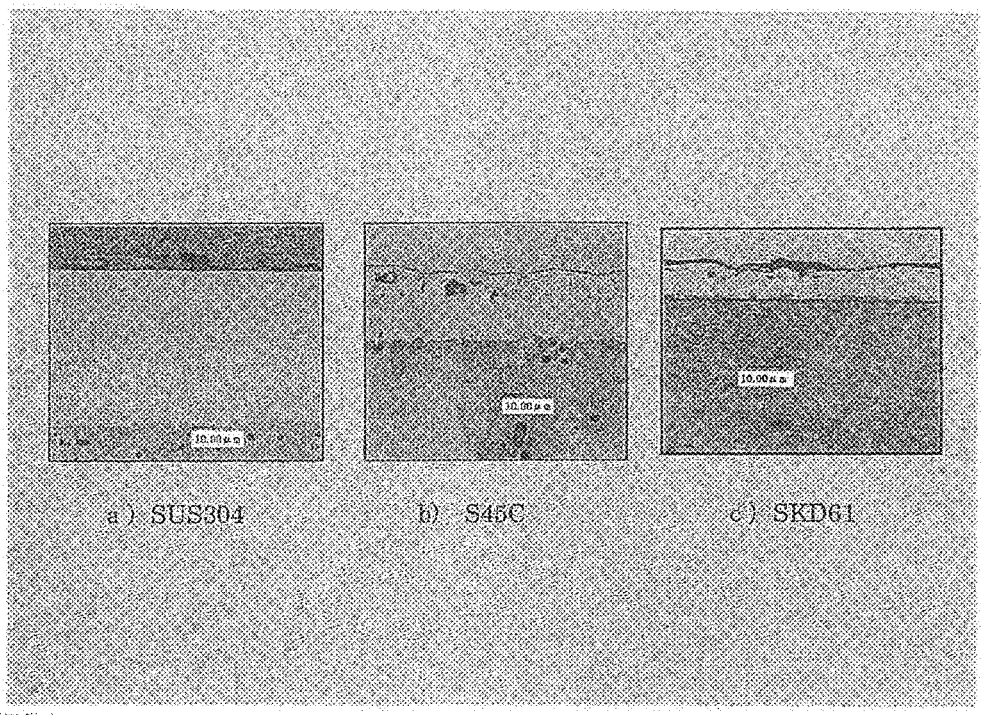
FIG. 3 is a cross-sectional micrograph of the example.

FIG. 3 is a cross-sectional micrograph of an example. The cross section of a test piece on which fluorination treatment, nitride processing, and chromizing treatment were performed was observed. Base materials were a) SUS304, b) S45C, c) SKD61. Comparing with the condition of FIG. 1 shows that a surface reformed layer has been achieved.

Figure 4:
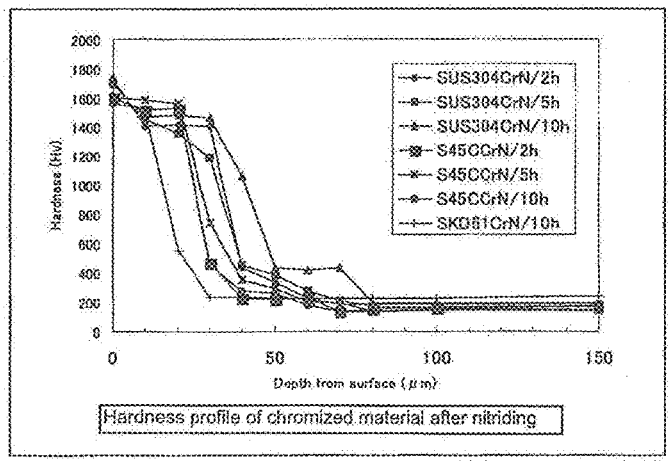
FIG. 4 is the measurement results of the cross-sectional hardness distribution of the example.

FIG. 4 is the measurement results of the cross-sectional hardness distribution of an example. The cross section hardness of a test piece on which nitride processing and chromizing treatment were performed was measured.

The base material and chromizing treatment time were as follows.

a) Base material SUS304+chromizing treatment 2 Hr b) Base material SUS304 +chromizing treatment 5 Hr c) Base material SUS304+chromizing treatment 10 Hr d) Base material S45C+chromizing treatment 2 Hr e) Base material S45C+chromizing treatment 5 Hr f) Base material S45C+chromizing treatment 10 Hr g) Base material SKD61+chromizing treatment 10 Hr There are slight differences depending on the steel type and chromizing treatment time but overall a surface layer with a hardness of Hv1300 or higher and roughly 20 to 35 μm is formed.

Figure 5:
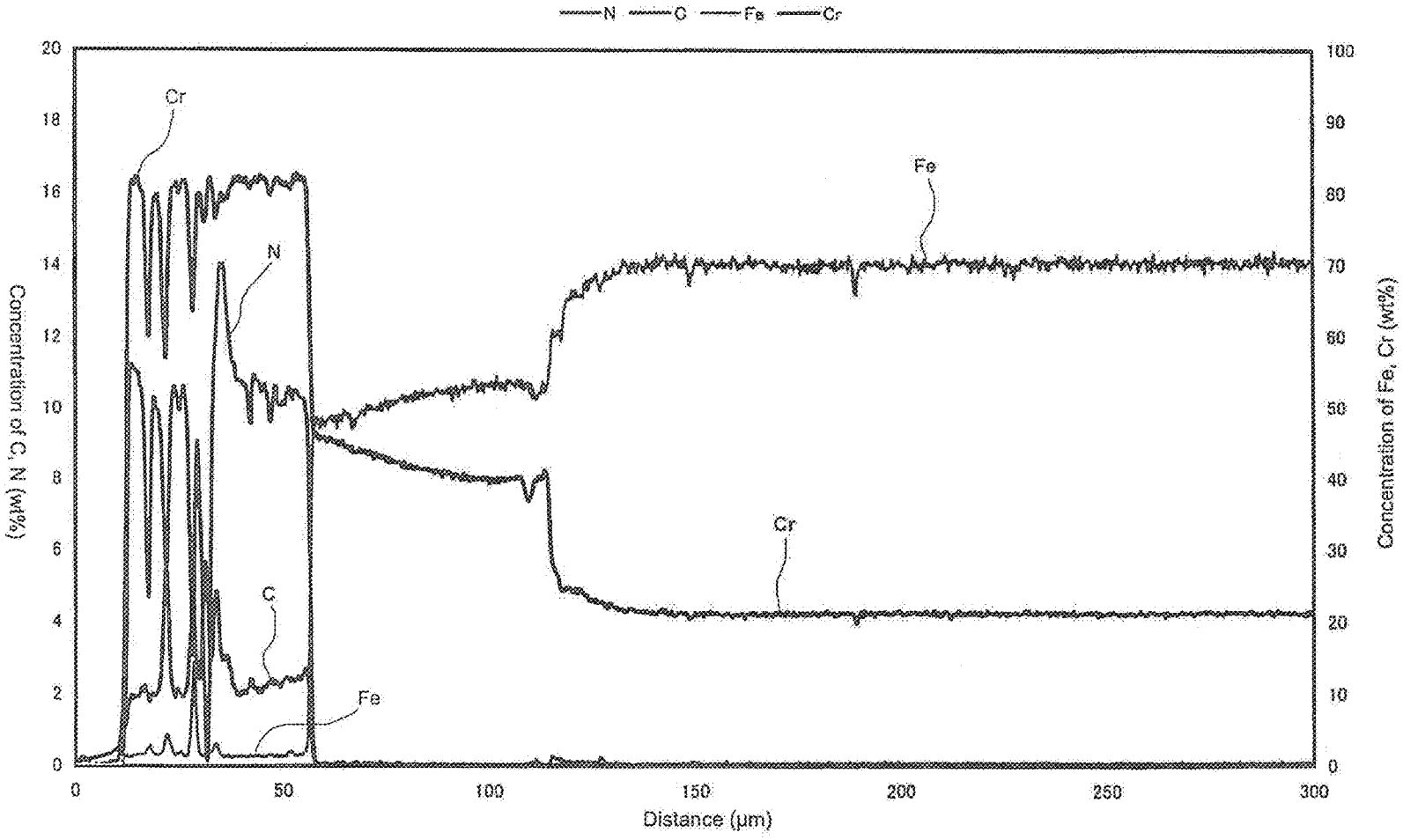
FIG. 5 (*a*) is the element distribution condition of the surface reformed layer formed on the example.
Figure 5:
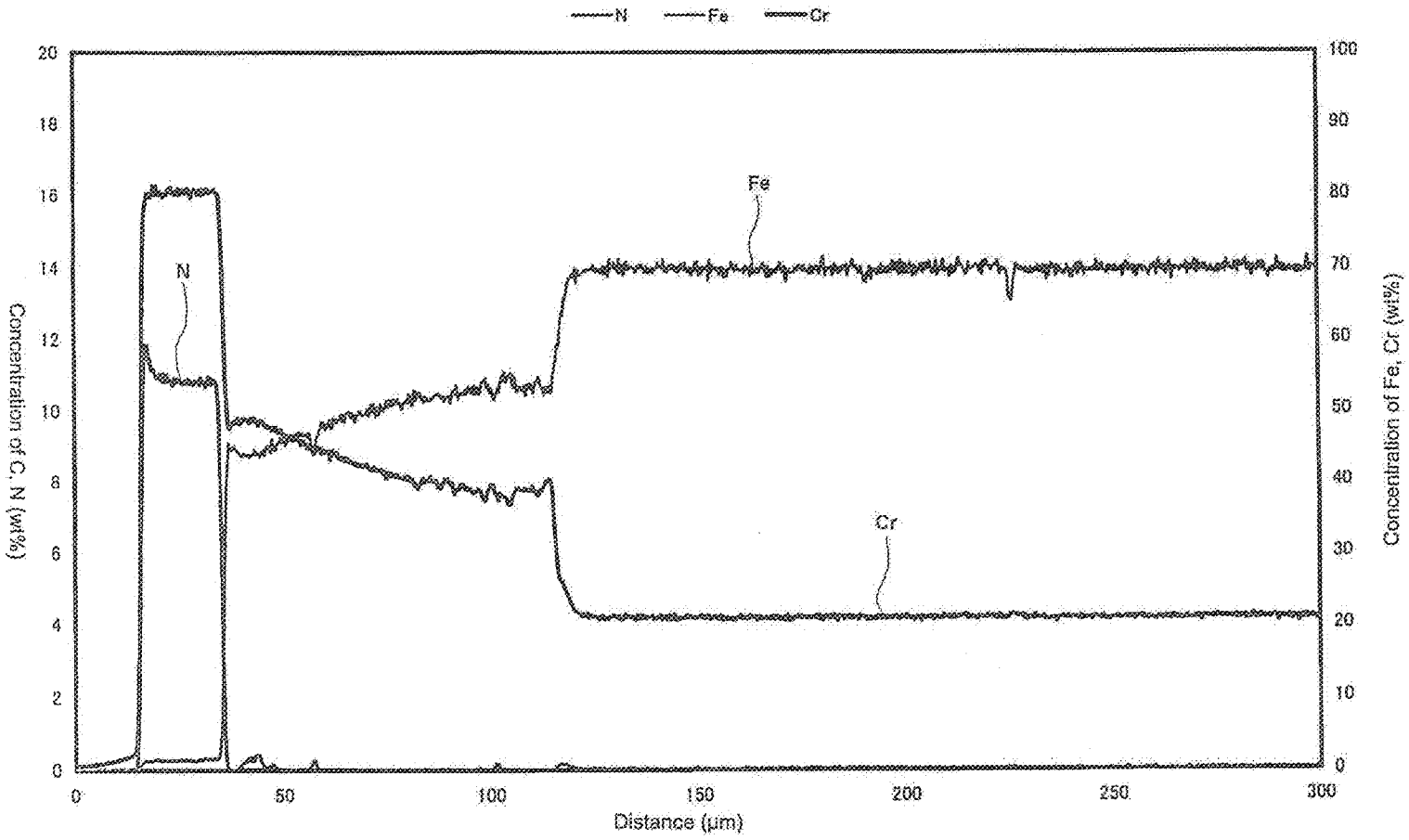

FIG. 5(*a*) and FIG. 5 (*b*) are the element distribution conditions of the surface reformed layer formed on the examples. For measurements, the concentration distribution of the material cross section was measured using an EPMA (X-ray micro analyzer).

FIG. 5 (*a*) shows the surface reformed layer formed through fluorination treatment, nitrocarburizing treatment, and chromizing treatment performed on a SUS304 base material. Nitrocarburizing treatment was at 570° C. for 2 hours.

FIG. 5 (*b*) shows the surface reformed layer formed through fluorination treatment, nitride processing, and chromizing treatment performed on a SUS304 base material. The nitride processing was at 570° C. for 30 minutes.

Both have a layer roughly 50 μm thick formed on the surface where Cr and N concentrations are high and Fe concentration is low. This can be viewed as a chromium nitride layer. This chromium nitride layer is approximately 82 weight % chromium and 11 weight % nitrogen and can be identified as $Cr_2N$. Further, a layer of roughly 60 μm thick with low nitrogen concentration and high Fe and Cr concentration is formed underneath this. This can be viewed as the chromium enriched layer where chromium is diffusion penetrated into the base material.

In this manner, differing dramatically with the chromium nitride films obtained through other conventional methods, the chromium nitride layer is thick and in addition forming of a thick layer with high concentration of chromium formed under this chromium nitride layer is seen making it clear this is a breakthrough level treatment.

Figure 6:
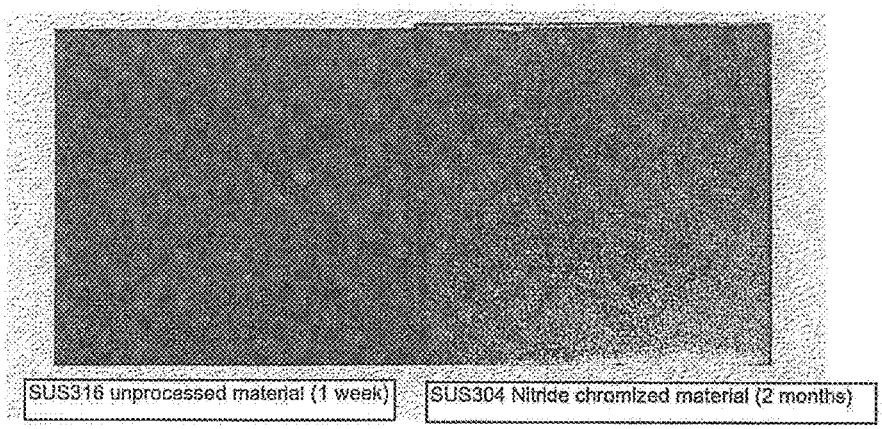
FIG. 6 shows the results of salt water spray test on the example and comparative example.

FIG. 6 shows the results of salt water spray test based on JIS Z2371 on the example and comparative example.

Comparative example: test piece on which fluorination treatment and nitride processing were performed and chromizing treatment was not performed. Base material was SUS316. Red rust was generated over the entire test piece in one week.

Example: test piece on which fluorination treatment, nitride processing, and thereafter chromizing treatment were performed. Base material was SUS304. There were no changes even after two months.

This shows that the example has superior corrosion resistance than the comparative example.

Figure 7:
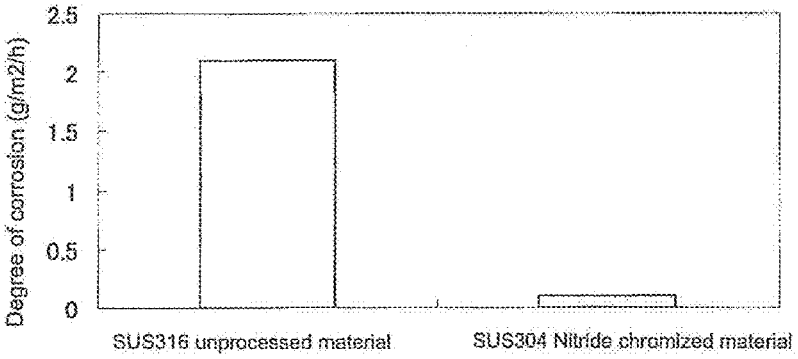
FIG. 7 shows the results of immersion test in HCl solution on the example and comparative example.

FIG. 7 shows the results of immersion test in 1% HCl solution on the example and comparative example. Temperature was 60° C. and immersion time was six hours.

Comparative example: SUS316 unprocessed sample. This showed a corrosion level of approximately 2.1 $g/m^2$-Hr.

Example: fluorination, nitriding, and thereafter chromizing treatment were performed on SUS304. This showed a corrosion level of approximately 0.1 g/m$^2$-Hr.

The example had a much lower level of corrosion than the comparative example showing much superior corrosion resistance.

Figure 8:
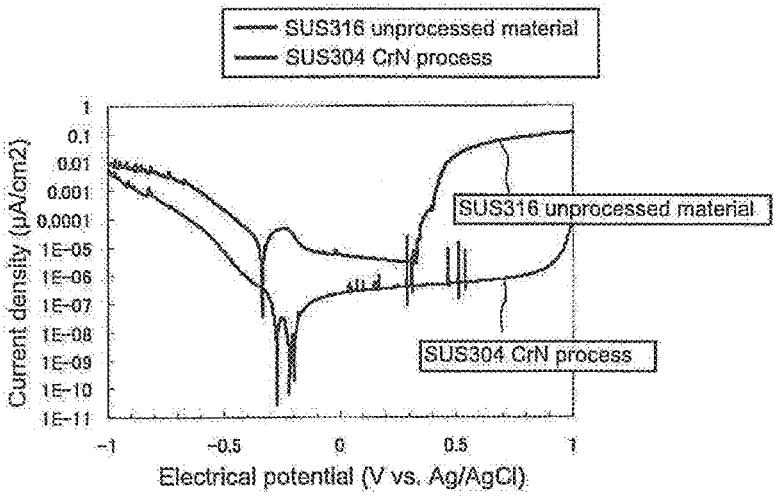
FIG. 8 shows the results of polarization curve measurements on the example and comparative example.

FIG. 8 shows the results of performing a dissolution loss test in an aluminum bath on the example and comparative example. The temperature was 60° C.

Comparative example: SUS316 unprocessed sample. Here the current density rose suddenly near −0.3 V, showed active dissolution peak, pitting corrosion occurred near 0.3 V and current increased dramatically.

Example: test piece on which fluorination treatment, nitride processing and thereafter chromizing treatment were performed. Base material was SUS304. This did not show an active dissolution peak and maintained inactive state up to close to 1 V.

This shows that the example has much superior corrosion resistance than the comparative example.

Figure 9:
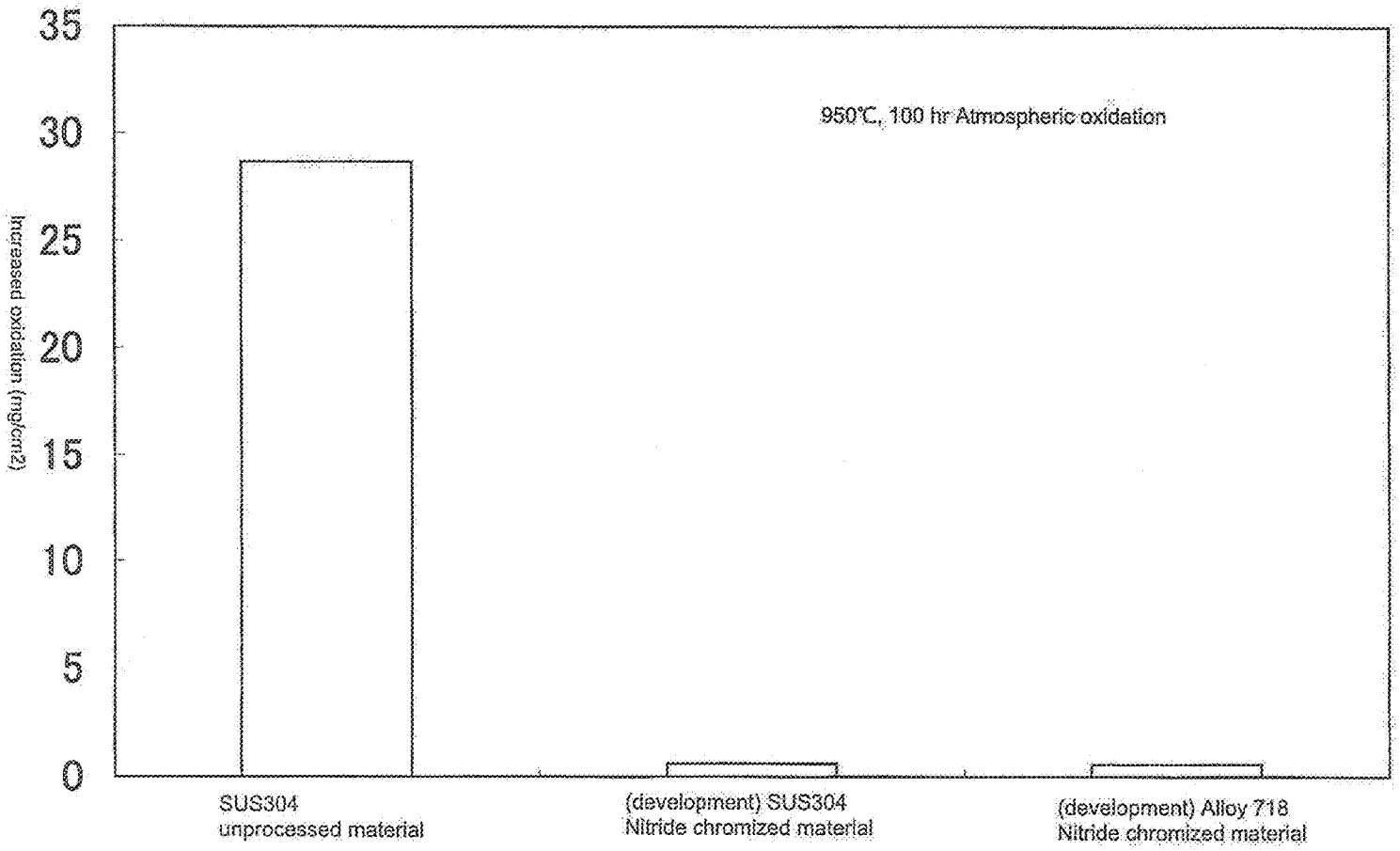
FIG. 9 is the test results of determining the oxidation resistance at high temperature of the example and comparative example.

FIG. 9 is the test results of determining the oxidation resistance at high temperature of the example and comparative example. Continuous oxidation was performed in atmosphere at a temperature of 950° C. for 100 hours and the increasing amount of oxidation was measured.

Comparative example: SUS304 unprocessed sample. This showed an increase of approximately 29 mg/cm$^2$.

Example: SUS304 material on which fluorination treatment, nitride processing and thereafter chromizing treatment were performed. This showed an increase of approximately 0.3 mg/cm$^2$.

Example: Alloy718 on which fluorination treatment, nitride processing, and thereafter chromizing treatment were performed. This showed an increase of approximately 0.2 mg/cm$^2$.

The examples show superior oxidation resistance compared to the unprocessed SUS304 material and clearly has stable oxidation resistance similar to that of unprocessed SUS310 material.

Figure 10:
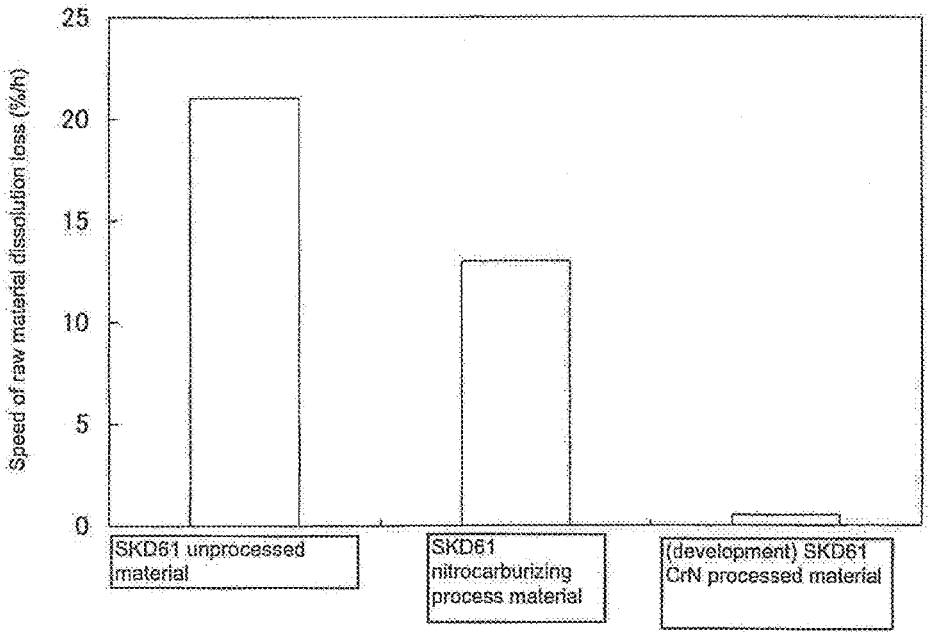
FIG. 10 shows the results of performing a dissolution loss test in an aluminum bath on the example and comparative example.

FIG. 10 shows the results of performing a dissolution loss test in an aluminum bath on the example and comparative example. The test pieces were immersed in an aluminum bath at 700° C. and the speed of weight reduction due to dissolution loss was measured.

Comparative example: SKD61 unprocessed sample. The speed of dissolution loss weight reduction was approximately 21%/Hr.

Comparative example: SKD61 nitrocarburizing treated material. The speed of dissolution loss weight reduction was approximately 13%/Hr.

Example: nitriding and then chromizing treatment were performed on SKD61. The speed of dissolution loss weight reduction was approximately 1%/Hr.

It is clear that the example shows superior performance as compared to the comparative example.

Figure 11:
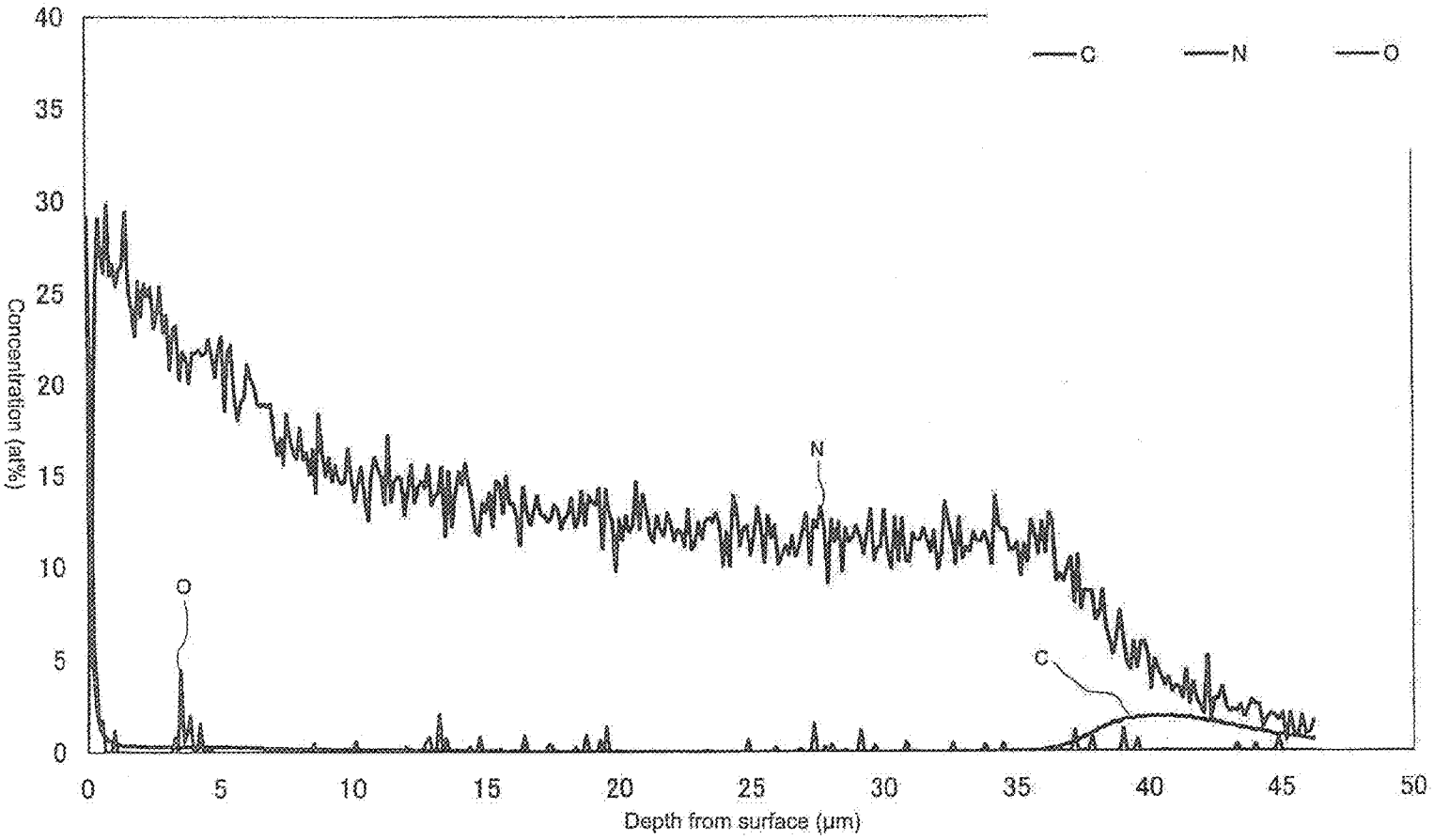
FIG. 11 is a cross section nitrogen concentration distribution of test samples prior to chromizing processing on the example.

FIG. 11 is a cross section nitrogen concentration distribution of test samples prior to chromizing processing on the example.

Base material was SUS304. Fluorination treatment and nitride processing were performed and measurements were performed prior to chromizing treatment. For measurements, the concentration distribution of the material cross section was measured using an EPMA (X-ray micro analyzer).

The layer where nitrogen concentration is 10 atom % or higher is formed from the surface to a depth of 35 μm. In order to obtain a chromium nitride layer with the desired thickness, the layer where nitrogen concentration is 10 atom % or higher is preferably to a depth of at least 5 μm or more from the surface and more preferably to 10 μm or more.

Modified Example

Particularly preferable examples of the present invention have been described as shown above; however, the present invention is not limited to the examples shown and can be implemented through various types of modifications and the intention of the present invention is to include various modified examples of the present invention.

What is claimed is:

1. A metal surface reforming method comprising the steps of performing nitride processing on a base material of iron based metal or nickel based metal of heating and retaining the base material in an atmosphere containing a nitrogen source gas to form a diffusion layer with diffused nitrogen with a nitrogen concentration of 10 atom % or higher and thickness of 5 μm or more, and then performing chromizing treatment by heating and retaining the nitrided base material in a powder containing metallic chromium at a temperature of 850 to 1200° C. to form a surface reformed layer on the base material.

2. The metal surface reforming method according to claim 1 wherein the surface reformed layer comprises a chromium compound layer formed on a surface and a chromium enriched layer formed underneath the chromium compound layer.

3. The metal surface reforming method according to claim 2 wherein the base material is an austenite based metal.

4. The metal surface reforming method according to claim 3 wherein the metal surface reforming method comprises a halogenation treatment of heating and retaining the base material in an atmosphere containing a halogen based gas prior to nitride processing.

5. The metal surface reforming method according to claim 2 wherein the metal surface reforming method comprises a halogenation treatment of heating and retaining the base material in an atmosphere containing a halogen based gas prior to nitride processing.

6. The metal surface reforming method according to claim 1, wherein the base material is an austenite based metal.

7. The metal surface reforming method according to claim 6 wherein the metal surface reforming method comprises a halogenation treatment of heating and retaining the base material in an atmosphere containing a halogen based gas prior to nitride processing.

8. The metal surface reforming method according to claim 1 wherein the metal surface reforming method comprises a halogenation treatment of heating and retaining the base material in an atmosphere containing a halogen based gas prior to nitride processing.

* * * * *